US011619428B2

(12) United States Patent
Moore

(10) Patent No.: US 11,619,428 B2
(45) Date of Patent: Apr. 4, 2023

(54) INTEGRATED SEPARATOR AND DISTRIBUTOR

(71) Applicant: Carrier Corporation, Palm Beach Gardens, FL (US)

(72) Inventor: Bryce Kirk Moore, Broomfield, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 86 days.

(21) Appl. No.: 17/045,633

(22) PCT Filed: Apr. 2, 2019

(86) PCT No.: PCT/US2019/025311

§ 371 (c)(1),
(2) Date: Oct. 6, 2020

(87) PCT Pub. No.: WO2019/195232

PCT Pub. Date: Oct. 10, 2019

(65) Prior Publication Data

US 2021/0156598 A1 May 27, 2021

Related U.S. Application Data

(60) Provisional application No. 62/653,870, filed on Apr. 6, 2018.

(51) Int. Cl.
*F25B 39/00* (2006.01)
*F25B 39/02* (2006.01)
(Continued)

(52) U.S. Cl.
CPC ..... *F25B 39/028* (2013.01); *F25B 43/00* (2013.01); *F25B 2339/0242* (2013.01);
(Continued)

(58) Field of Classification Search
CPC ..... F25B 39/02; F25B 39/028; F25B 43/00; F25B 2339/0242; F25B 2400/23;
(Continued)

(56) References Cited

U.S. PATENT DOCUMENTS 5,561,987 A * 10/1996 Hartfield ..... F28D 3/02 165/117
5,645,124 A 7/1997 Hartfield et al.
(Continued)

FOREIGN PATENT DOCUMENTS

CN 100451496 C 1/2009
CN 102252468 A 11/2011
(Continued)

OTHER PUBLICATIONS

International Search Report for International Application No. PCT/2019/025311; International filing date: Apr. 2, 2019; dated Jun. 19, 2019; 5 pages.
(Continued)

*Primary Examiner* — Harry E Arant
(74) *Attorney, Agent, or Firm* — Cantor Colburn LLP

(57) ABSTRACT

A separator and distributor assembly for a falling film evaporator housed within the evaporator shell includes a housing defining a separation volume, a refrigerant inlet configured to admit a liquid and vapor refrigerant flow into the separation volume and one or more refrigerant gutters extending along a lengthwise axis of the housing. The refrigerant gutter has a gutter inlet at a bottom of the separation volume, and the one or more refrigerant gutters are configured to receive separated liquid refrigerant from the separation volume. One or more sparge channels are in fluid communication with the refrigerant gutters. The sparge channel includes one or more sparge openings at a top of the sparge channel vertically below the gutter inlet. The one or
(Continued)

more sparge openings are configured to flow liquid refrigerant therefrom.

16 Claims, 6 Drawing Sheets

(51) Int. Cl.
*F25B 43/00* (2006.01)
*F28D 3/04* (2006.01)
*F28D 5/02* (2006.01)
*F28F 9/22* (2006.01)

(52) U.S. Cl.
CPC ..... *F25B 2400/23* (2013.01); *F28D 3/04* (2013.01); *F28D 5/02* (2013.01); *F28F 2009/224* (2013.01)

(58) Field of Classification Search
CPC ... F25B 43/02; F28D 3/04; F28D 5/05; F28D 7/16; F28F 2009/224
See application file for complete search history.

(56) References Cited

U.S. PATENT DOCUMENTS

| | | | | |
|---|---|---|---|---|
| 5,836,382 | A | 11/1998 | Dingle et al. | |
| 6,167,713 | B1 | 1/2001 | Hartfield et al. | |
| 6,293,112 | B1 | 9/2001 | Moeykens et al. | |
| 6,830,099 | B2 | 12/2004 | Moeykens | |
| 6,868,695 | B1 | 3/2005 | Dingel et al. | |
| 7,421,855 | B2 | 9/2008 | Ring et al. | |
| 8,944,152 | B2 | 2/2015 | Kulankara et al. | |
| 9,377,226 | B2 | 6/2016 | Kang | |
| 9,513,039 | B2 | 12/2016 | Numata et al. | |
| 9,759,461 | B2 | 9/2017 | Numata et al. | |
| 2014/0311182 | A1 | 10/2014 | Christians et al. | |
| 2016/0025416 | A1 | 1/2016 | Pitts et al. | |
| 2016/0040917 | A1 | 2/2016 | Liu et al. | |
| 2016/0109182 | A1 | 4/2016 | Xu et al. | |
| 2016/0146518 | A1 | 5/2016 | Liu et al. | |
| 2016/0305695 | A1 | 10/2016 | Christians et al. | |
| 2017/0153061 | A1* | 6/2017 | Yoshioka | F28D 3/04 |
| 2017/0254573 | A1* | 9/2017 | Numata | F28D 3/04 |
| 2020/0370802 | A1* | 11/2020 | Giancotti | F28D 5/00 |

FOREIGN PATENT DOCUMENTS

| | | | |
|---|---|---|---|
| CN | 202133192 | U | 2/2012 |
| CN | 202885362 | U | 4/2013 |
| CN | 203083207 | U | 7/2013 |
| CN | 103277952 | A | 9/2013 |
| CN | 103673420 | B | 3/2014 |
| CN | 103851839 | A | 6/2014 |
| CN | 203908117 | U | 10/2014 |
| CN | 203908119 | U | 10/2014 |
| CN | 105091417 | B | 11/2015 |
| CN | 205425941 | U | 8/2016 |
| CN | 106482400 | A | 3/2017 |
| CN | 106969555 | A | 7/2017 |
| CN | 107091545 | A | 8/2017 |
| EP | 2841867 | B1 | 7/2016 |
| JP | 2014070723 | A | 2/2014 |
| WO | 2015034573 | A1 | 3/2015 |
| WO | 2015099872 | A1 | 7/2015 |
| WO | 2015108902 | A1 | 7/2015 |
| WO | 2016191417 | A1 | 12/2016 |

OTHER PUBLICATIONS

Written Opinion for International Application No. PCT/US2019/025311; International filing date: Apr. 2, 2019; dated Jun. 19, 2019; 7 pages.
Chinese Office Action for Chinese Application No. 201980024506.7; dated Dec. 1, 2021; 7 pages.

* cited by examiner

INTEGRATED SEPARATOR AND DISTRIBUTOR

CROSS REFERENCE TO RELATED APPLICATIONS

This application is a National Stage application of PCT/US2019/25311, filed Apr. 2, 2019, which claims the benefit of U.S. Provisional Application No. 62/653,870, filed Apr. 6, 2018, the disclosures of which are incorporated herein by reference in their entirety.

BACKGROUND

Exemplary embodiments pertain to the art of heating, ventilation, air conditioning and refrigeration (HVAC&R) systems. More specifically, the present disclosure relates to falling film evaporators for HVAC&R systems.

HVAC&R systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. This results in a particularly high volume of refrigerant necessary, depending on a quantity and size of evaporator tubes, for efficient system operation. Another type of evaporator used in chiller systems is a falling film evaporator. In a falling film evaporator, the evaporator tubes are positioned typically below a distribution manifold from which refrigerant is urged, forming a "falling film" on the evaporator tubes.

In a typical falling film evaporator, an expanded mixture of refrigerant liquid and vapor is conveyed by a pipe or piping network into the evaporator and distribution device, which meters the flow of liquid refrigerant over the evaporator tubes. Separation volumes and liquid-filled distribution manifolds can provide reliable metering of liquid refrigerant to the bundle, but can often lead to significant refrigerant charge holdup. This can have cost and regulatory impacts, from calculated greenhouse gas emissions.

BRIEF DESCRIPTION

In one embodiment, a separator and distributor assembly for a falling film evaporator housed within the evaporator shell includes a housing defining a separation volume, a refrigerant inlet configured to admit a liquid and vapor refrigerant flow into the separation volume and one or more refrigerant gutters extending along a lengthwise axis of the housing. The refrigerant gutter has a gutter inlet at a bottom of the separation volume, and the one or more refrigerant gutters are configured to receive separated liquid refrigerant from the separation volume. One or more sparge channels are in fluid communication with the refrigerant gutters. The sparge channel includes one or more sparge openings at a top of the sparge channel vertically below the gutter inlet. The one or more sparge openings are configured to flow liquid refrigerant therefrom.

Additionally or alternatively, in this or other embodiments the one or more refrigerant gutters extend from a first longitudinal end to a second longitudinal end of the separation volume.

Additionally or alternatively, in this or other embodiments the one or more refrigerant gutters are two refrigerant gutters. The two refrigerant gutters are located at opposing lateral sides of the separation volume.

Additionally or alternatively, in this or other embodiments the assembly includes two sparge channels, each sparge channel connected to a refrigerant gutter of the two refrigerant gutters.

Additionally or alternatively, in this or other embodiments the one or more sparge channels vary in one or more of a sparge channel depth or a sparge channel width along the lengthwise axis.

Additionally or alternatively, in this or other embodiments a baffle is located in the separation volume extending at least partially across the refrigerant inlet.

Additionally or alternatively, in this or other embodiments a distribution manifold is located below the sparge channel and in fluid communication therewith.

Additionally or alternatively, in this or other embodiments a vent opening is located at the separation volume. The vent opening is configured to vent vapor refrigerant from the separation volume.

In another embodiment, a falling film evaporator includes an evaporator housing, a plurality of evaporator tubes through which a volume of thermal energy transfer medium is flowed, and a separator and distributor assembly for a falling film evaporator. The assembly includes a separator housing defining a separation volume, a refrigerant inlet configured to admit a liquid and vapor refrigerant flow into the separation volume, and one or more refrigerant gutters extending along a lengthwise axis of the housing. The refrigerant gutter has a gutter inlet at a bottom of the separation volume. The one or more refrigerant gutters are configured to receive separated liquid refrigerant from the separation volume. One or more sparge channels are in fluid communication with the refrigerant gutters. The sparge channel includes one or more sparge openings at a top of the sparge channel vertically below the gutter inlet. The one or more sparge openings are configured to flow liquid refrigerant therefrom.

Additionally or alternatively, in this or other embodiments the one or more refrigerant gutters extend from a first longitudinal end to a second longitudinal end of the separation volume.

Additionally or alternatively, in this or other embodiments the one or more refrigerant gutters are two refrigerant gutters. The two refrigerant gutters are located at opposing lateral sides of the separation volume.

Additionally or alternatively, in this or other embodiments the assembly includes two sparge channels, each sparge channel connected to a refrigerant gutter of the two refrigerant gutters.

Additionally or alternatively, in this or other embodiments a baffle is located in the separation volume extending across the refrigerant inlet.

Additionally or alternatively, in this or other embodiments a distribution manifold is located below the sparge channel and in fluid communication therewith.

Additionally or alternatively, in this or other embodiments a vent opening is located at the separation volume. The vent opening is configured to vent vapor refrigerant from the separation volume.

In yet another embodiment, a method of operating a falling film evaporator includes flowing a liquid and vapor refrigerant into a separation volume of a separator and distributor assembly, separating a liquid refrigerant from the liquid and vapor refrigerant at the separation volume, and flowing the liquid refrigerant through a refrigerant gutter at the bottom of the separation volume into a sparge channel. The refrigerant gutter extends into a sparge channel disposed outside of the separation volume. The liquid refrigerant is urged out of one or more sparge openings at a top of the sparge channel via refrigerant pressure in the separation volume.

Additionally or alternatively, in this or other embodiments the liquid refrigerant is flowed from the one or more sparge openings to a distribution manifold disposed below the sparge channel, and the liquid refrigerant is flowed from the distribution manifold over a plurality of evaporator tubes.

Additionally or alternatively, in this or other embodiments at least a portion of the liquid and vapor refrigerant is impinged onto a baffle disposed at least partially across the refrigerant inlet.

Additionally or alternatively, in this or other embodiments vapor refrigerant is vented from the separation volume via a vent opening in the separation volume.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
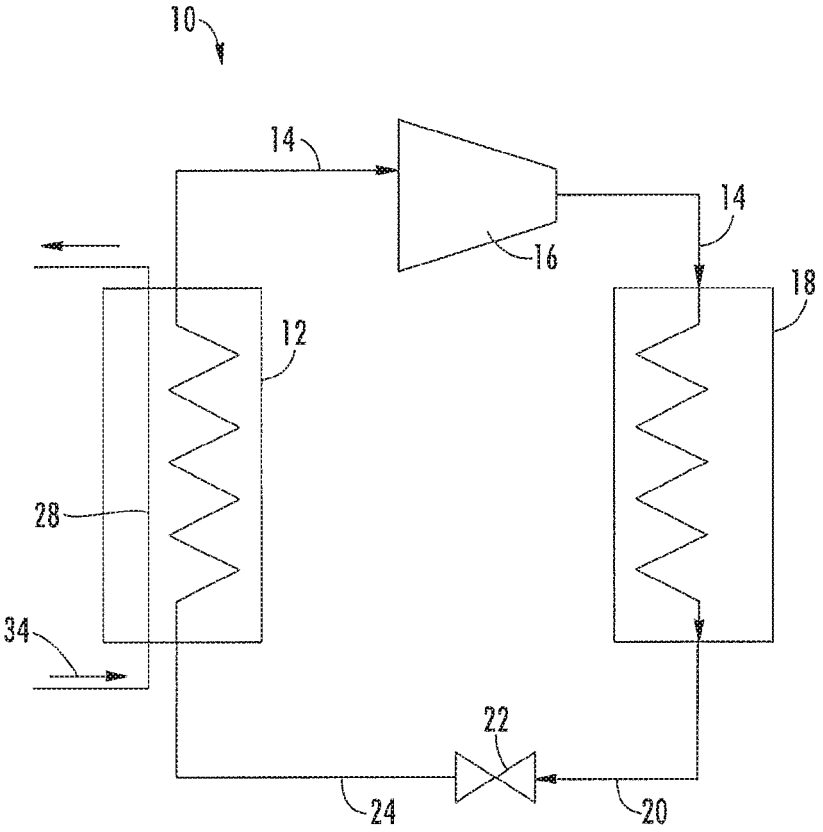
FIG. 1 is a schematic view of an embodiment of a heating, ventilation, air conditioning and refrigeration system.

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 toward the evaporator 12.

Figure 2:
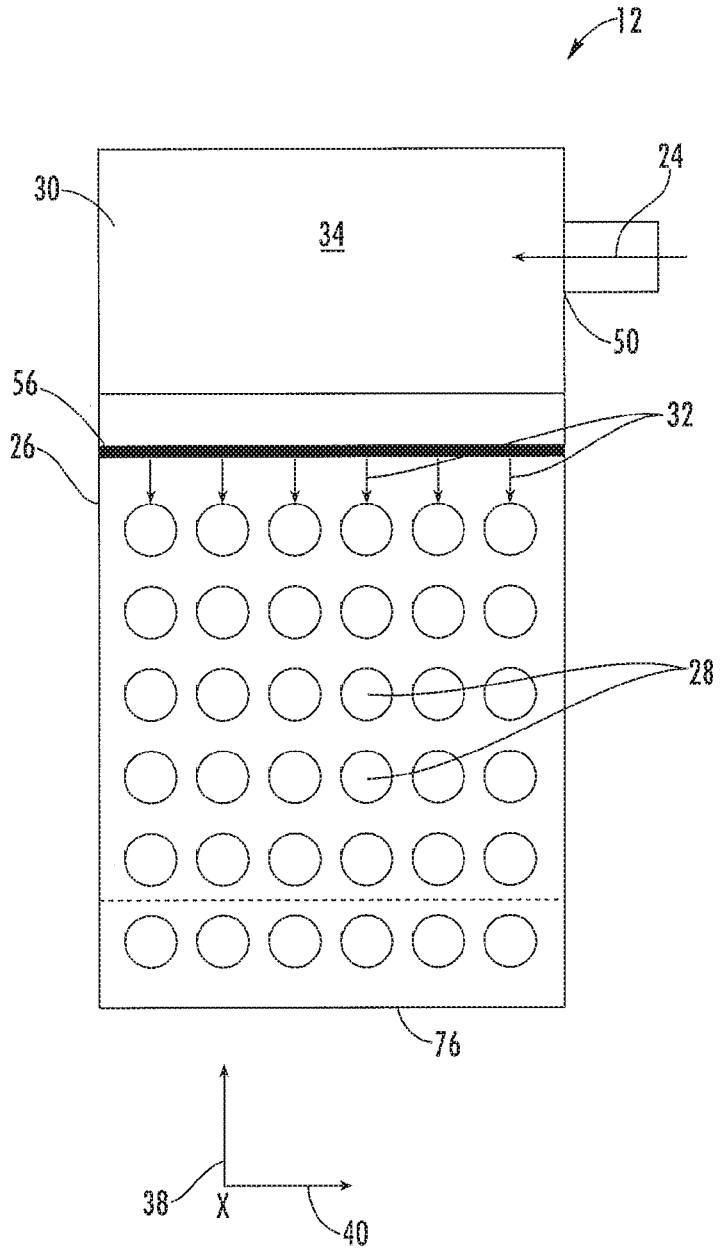
FIG. 2 is a schematic elevation view of an embodiment of a falling film evaporator.

Referring now to FIG. 2, as stated above, the evaporator 12 is a falling film evaporator. The evaporator 12 includes an evaporator housing 26 with the evaporator 12 components disposed at least partially therein, including a plurality of evaporator tubes 28. An integral separator and distributor 30 is located in the housing 26 above the evaporator tubes 28 to distribute liquid refrigerant 32 over the evaporator tubes 28. A thermal energy exchange occurs between a flow of heat transfer medium 34 (shown in FIG. 1) flowing through the evaporator tubes 28 into and out of the evaporator 12 and the liquid refrigerant 32.

Figure 3:
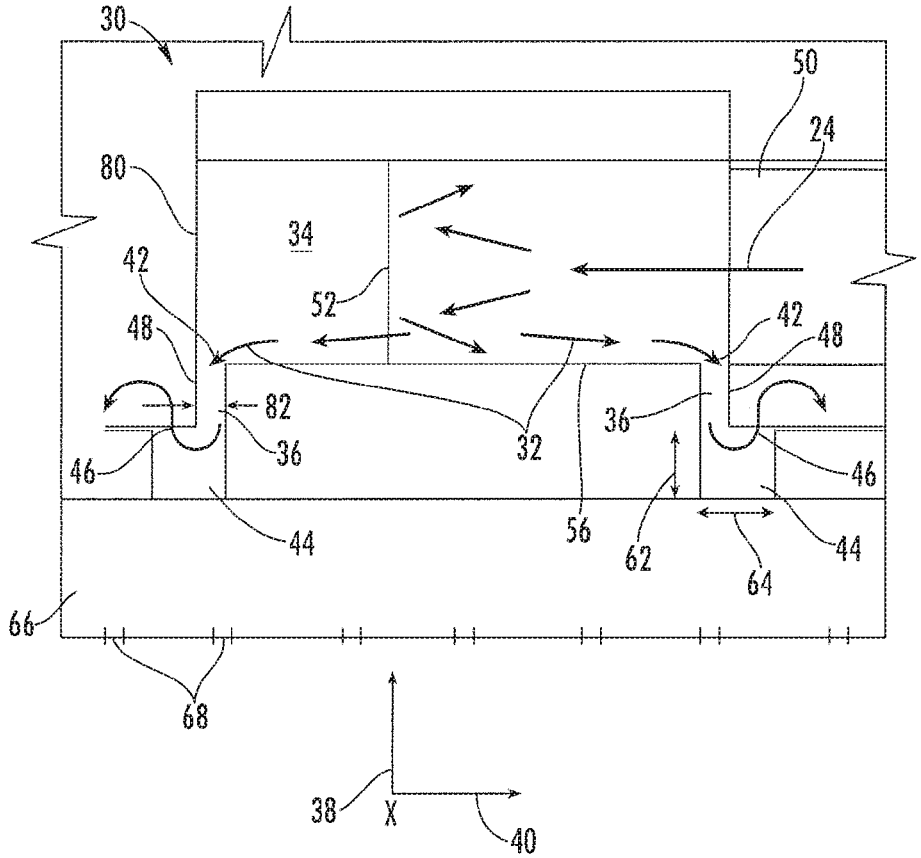
FIG. 3 is a cross-sectional view of an embodiment of an integral separator and distributor of a falling film evaporator.

Referring now to FIG. 3, the integral separator and distributor 30 includes a housing 80 defining a separation volume 34 which flows the separated liquid refrigerant 32 into one or more refrigerant gutters 36 extending along a lengthwise axis 38 of the integral separator and distributor 30. The lengthwise axis 38 extends parallel to the length of the evaporator tubes 28, as best shown in FIG. 2, while a lateral axis 40 extends horizontally perpendicular to the lengthwise axis 38.

The refrigerant gutters 36 have a gutter inlet 42 connecting the separation volume 34 to a sparge channel 44 at the bottom of the separation volume 34 and extending along the lengthwise axis 38. The sparge channel 44 includes one or more sparge outlets 46 located in an upper surface 48 of the sparge channel 44, vertically below the separation volume 34 and vertically below the gutter inlet 42. Further, the sparge channel 44 includes a sparge channel depth 62 and a sparge channel width 64, and the refrigerant gutter 36 has a gutter width 82. The sparge channels 44 are sized and configured to provide a desired pressure drop, which is based on a desired cooling capacity, or flow rate of liquid refrigerant 32. In some embodiments, the sparge outlets 46 are sized and numbered for a 25 mm liquid refrigerant head. Further, the sparge channel depth 62 is at least 2.5 times the sparge outlet hydraulic diameter. In some embodiments, the sparge channel depth 62 is in the range of 3 to 4.5 centimeters, while the sparge channel width 64 is in the range of 4.5 to 7 centimeters.

Further, the refrigerant gutter 36 is sized to provide self-venting liquid flow to the sparge channels 44, which is a function of system cooling capacity and gutter 12 length. In some embodiments, the refrigerant gutter 36 has a gutter width 82 in the range of about 0.5-1.5 centimeters, and a gutter height between a bottom of the separation volume 34 and the sparge channel 44 between about 4.5 and 5.5 centimeters.

Figure 4:
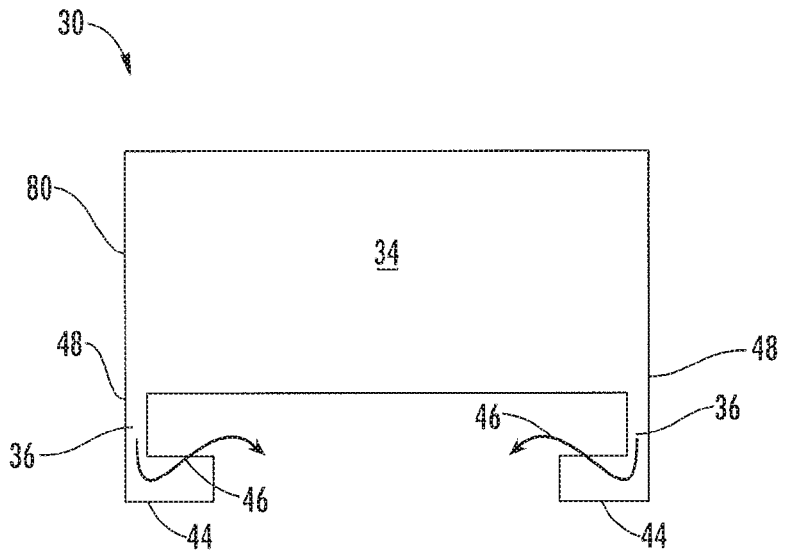
FIG. 4 is a cross-sectional view of another embodiment of an integral separator and distributor of a falling film evaporator.
Figure 5:
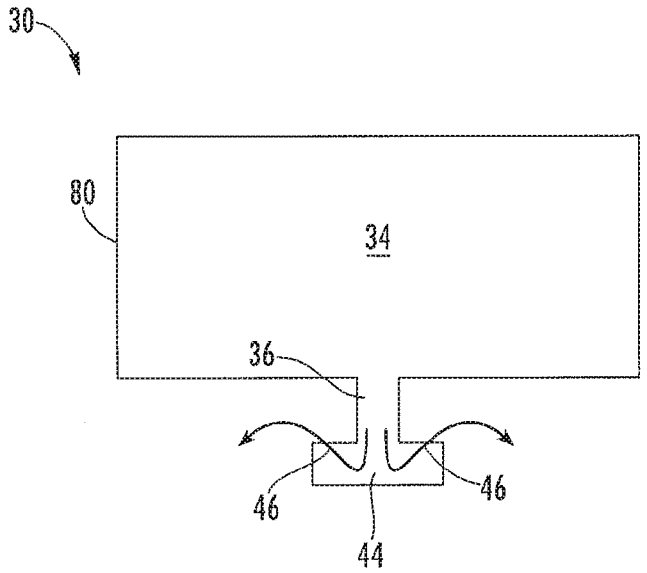
FIG. 5 is a cross-sectional view of yet another embodiment of an integral separator and distributor of a falling film evaporator.
Figure 6:
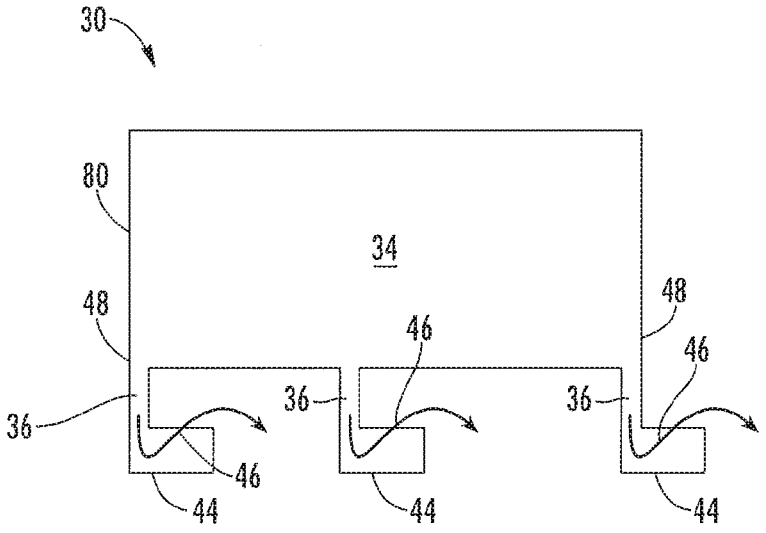
FIG. 6 is a cross-sectional view of still another embodiment of an integral separator and distributor of a falling film evaporator.

In some embodiments, such as shown in FIG. 3, the refrigerant gutters 36 are located at lateral sides 48 of the separation volume 34, with the sparge outlets 46 laterally outboard of the lateral sides 48 of the separation volume 34. In other embodiments, such as shown in FIGS. 4-6, the gutters 36 and sparge outlets 46 may be placed at other locations along the bottom of the separator volume 34. For example, in the embodiment of FIG. 4 the sparge outlets 46 are located laterally inboard of the lateral sides 48 of the separation volume 34. In the embodiment of FIG. 5, the refrigerant gutter 36 is located substantially at a lateral center of the separation volume 34, with the sparge channel 44 including multiple sparge outlets 46. Another embodiment is illustrated in FIG. 6, where two refrigerant gutters 36 are located at the lateral sides 48 of the separation volume 34 and a third refrigerant gutter 36 is located substantially at a lateral center of the separation volume 36. It is to be appreciated that the embodiments disclosed herein are exemplary, and that other locations of the refrigerant gutters 36 and sparge channels 44 are contemplated within the scope of the present disclosure.

Referring again to FIG. 3, the vapor and liquid refrigerant 24 enters the separation volume 34 via a refrigerant inlet 50. In some embodiments, a baffle 52 is disposed in the separation volume 34 spaced from the refrigerant inlet 50 and across the refrigerant inlet 50. As shown best in FIG. 7, the baffle 52 extends partially along a longitudinal length 54 of the separation volume 34.

Referring again to FIG. 3, as the vapor and liquid refrigerant 24 enters the separation volume 34 via the refrigerant inlet 50, the vapor and liquid refrigerant 24 impinges on the baffle 52. The impingement distributes the vapor and liquid refrigerant 24 throughout the separation volume 34. Liquid refrigerant 32 separated from the vapor and liquid refrigerant 24 settles to a bottom 56 of the separation volume 34, and flows into the sparge channels 44 via the refrigerant gutters 36. The liquid refrigerant 32 is urged through the sparge outlets 46 via the pressure of the liquid refrigerant 32 in the separation volume 34 and the sparge channels 44.

Figure 7:
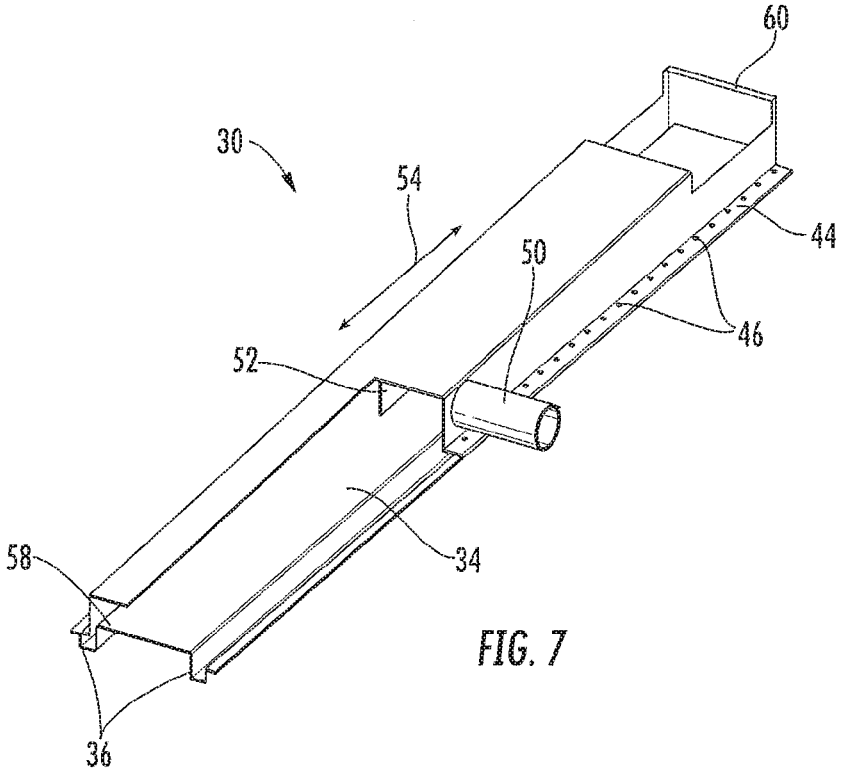
FIG. 7 is a perspective view of an embodiment of an integral separator and distributor of a falling film evaporator.

In some embodiments, such as shown in FIG. 7, the refrigerant gutters 36 and the sparge channels 44 extend longitudinally along the separator 30 from a first end 58 to a second end 60 of the separator 30. Extending the refrigerant gutters 36 and the sparge channels 44 along the length of the separator 30 provides a degree of pre-distribution of the liquid refrigerant 32 along the longitudinal length 54 of the distributor. Depending of the degree of such longitudinal pre-distribution of the liquid refrigerant 32 that is desired, in other embodiments the sparge channels 44 and the refrigerant gutters 36 may not extend fully from the first end 58 to the second end 60, but may extend partially along the longitudinal length 54, for example, along 5% to 99% of the longitudinal length 54. Further, while a single refrigerant gutter 36 and sparge channel 44 extends continuously from the first end 58 to the second end 60 in the embodiment of FIG. 7, in other embodiments, multiple refrigerant gutters 36 and/or sparge channels 44 may be located along the longitudinal length 54.

In some embodiments, such as in FIG. 7, the sparge outlets 46 are a plurality of circular openings, while in other embodiments other configurations may be utilized. For example, in some embodiments, the sparge outlets 46 may be multiple longitudinally-extended slots, or one continuous slot. Further, in some embodiments, the size, shape and/or spacing of the sparge outlets 46 may vary along the longitudinal length. Additionally, a sparge channel depth 62 and/or sparge channel width 64 may vary along the longitudinal length, for example, with distance from the refrigerant inlet 50 in order to equalize flow rates along the length.

Referring again to FIG. 3, a distribution manifold 66 is located below the sparge channels 44, between the sparge channels 44 and the evaporator tubes 28. The distribution manifold 66 includes a plurality of distribution openings 68 to allow the liquid refrigerant 32 to flow therethrough and onto the evaporator tubes 28.

Figure 8:
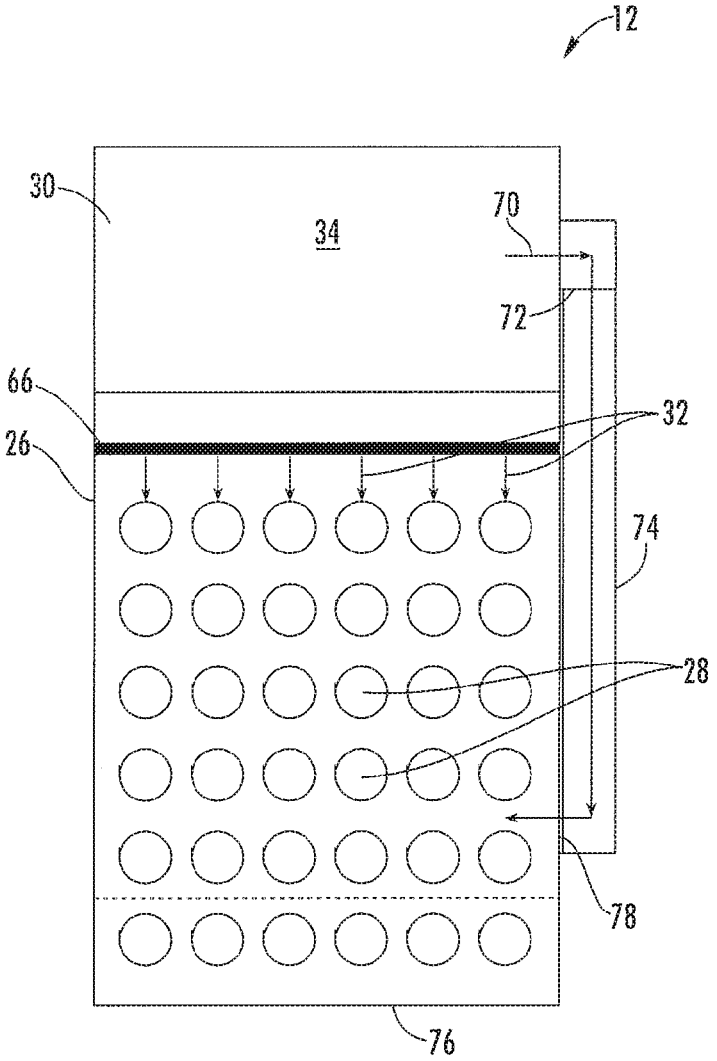
FIG. 8 is another cross-sectional view of an embodiment of an integral separator and distributor of a falling film evaporator.

Referring to FIG. 8, vapor refrigerant 70 is vented from the separation volume 34 at one or more vent openings 72. From the vent opening 72, a vent pathway 74 extends downwardly toward the evaporator bottom 76 and exits the vent pathway 74 at a vent exit 78 to join vapor refrigerant boiled off at the evaporator tubes 28. This vapor refrigerant 70 is returned to the compressor 16 via a suction port (not shown).

The integral separator and distributor 30 disclosed herein provides effective liquid refrigerant 32 distribution with reduced refrigerant charge (up to 15% of system charge) compared to other separator-manifold architectures used currently, while maintaining the near-ideal evaporator tube 28 bundle wetting and evaporator 12 performance. By supplying liquid refrigerant 32 to the distribution manifold 66 all along its length via the sparge channels 44, rather than feeding the distribution manifold at discrete locations, the distribution manifold 66 size required for effective distribution can be decreased. Compared to spray-based distribution systems, the configurations disclosed herein can provide superior liquid distribution to the evaporator tube 28 bundle, across a wider range of operating conditions.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A separator and distributor assembly for a falling film evaporator, housed within the evaporator shell, and comprising:

a housing defining a separation volume;

a refrigerant inlet configured to admit a liquid and vapor refrigerant flow into the separation volume;

one or more refrigerant gutters extending along a lengthwise axis of the housing, the refrigerant gutter having a gutter inlet at a bottom of the separation volume, the one or more refrigerant gutters configured to receive separated liquid refrigerant from the separation volume; and one or more sparge channels in fluid communication with the refrigerant gutters to receive the separated liquid refrigerant from the one or more refrigerant gutters, the sparge channel including one or more sparge openings at a top of the sparge channel vertically below the gutter inlet, the one or more sparge openings configured to flow liquid refrigerant from the one or more sparge channels and into a distribution manifold disposed below the sparge channel;

wherein the one or more sparge openings are disposed laterally inboard of the lateral sides of the separation volume.

2. The separator and distributor assembly of claim 1, wherein the one or more refrigerant gutters extend from a first longitudinal end to a second longitudinal end of the separation volume.

3. The separator and distributor assembly of claim 1, wherein the one or more refrigerant gutters are two refrigerant gutters, the two refrigerant gutters disposed at opposing lateral sides of the separation volume.

4. The separator and distributor assembly of claim 3, further comprising two sparge channels, each sparge channel connected to a refrigerant gutter of the two refrigerant gutters.

5. The separator and distributor assembly of claim 1, further comprising a baffle disposed in the separation volume extending at least partially across the refrigerant inlet.

6. The separator and distributor assembly of claim 1, further comprising a vent opening disposed at the separation volume, the vent opening configured to vent vapor refrigerant from the separation volume.

7. A falling film evaporator, comprising:

an evaporator housing;

a plurality of evaporator tubes through which a volume of thermal energy transfer medium is flowed; and a separator and distributor assembly for a falling film evaporator, comprising:

a separator housing defining a separation volume;

a refrigerant inlet configured to admit a liquid and vapor refrigerant flow into the separation volume;

one or more refrigerant gutters extending along a lengthwise axis of the housing, the refrigerant gutter having a gutter inlet at a bottom of the separation volume, the one or more refrigerant gutters configured to receive separated liquid refrigerant from the separation volume; and one or more sparge channels in fluid communication with the refrigerant gutters to receive the separated liquid refrigerant from the one or more refrigerant gutters, the sparge channel including one or more sparge openings at a top of the sparge channel vertically below the gutter inlet, the one or more sparge openings configured to flow liquid refrigerant from the one or more sparge channels and into a distribution manifold disposed below the sparge channel;

wherein the one or more sparge openings are disposed laterally inboard of the lateral sides of the separation volume.

8. The falling film evaporator of claim 7, wherein the one or more refrigerant gutters extend from a first longitudinal end to a second longitudinal end of the separation volume.

9. The falling film evaporator of claim 7, wherein the one or more refrigerant gutters are two refrigerant gutters, the two refrigerant gutters disposed at opposing lateral sides of the separation volume.

10. The falling film evaporator of claim 9, further comprising two sparge channels, each sparge channel connected to a refrigerant gutter of the two refrigerant gutters.

11. The falling film evaporator of claim 7, further comprising a baffle disposed in the separation volume extending across the refrigerant inlet.

12. The falling film evaporator of claim 7, further comprising a vent opening disposed at the separation volume, the vent opening configured to vent vapor refrigerant from the separation volume.

13. A method of operating a falling film evaporator, comprising:

flowing a liquid and vapor refrigerant into a separation volume of a separator and distributor assembly;

separating a liquid refrigerant from the liquid and vapor refrigerant at the separation volume;

flowing the liquid refrigerant through a refrigerant gutter at the bottom of the separation volume into a sparge channel, the refrigerant gutter extending into a sparge channel disposed outside of the separation volume; and urging the liquid refrigerant out of one or more sparge openings at a top of the sparge channel via refrigerant pressure in the separation volume; and flowing the liquid refrigerant from the one or more sparge openings to a distribution manifold disposed below the sparge channel;

wherein the one or more sparge openings are disposed laterally inboard of the lateral sides of the separation volume.

14. The method of claim 13, further comprising:

flowing the liquid refrigerant from the distribution manifold over a plurality of evaporator tubes.

15. The method of claim 13, further comprising impinging at least a portion of the liquid and vapor refrigerant onto a baffle disposed at least partially across the refrigerant inlet.

16. The method of claim 13, further comprising venting vapor refrigerant from the separation volume via a vent opening in the separation volume.

* * * * *